US010813418B1

(12) United States Patent
Tully

(10) Patent No.: US 10,813,418 B1
(45) Date of Patent: Oct. 27, 2020

(54) LANYARD WITH DOUBLE FASTENER

(71) Applicant: Francis Edward Tully, Spring Hill, FL (US)

(72) Inventor: Francis Edward Tully, Spring Hill, FL (US)

( * ) Notice: Subject to any disclaimer, the term of this patent is extended or adjusted under 35 U.S.C. 154(b) by 0 days.

(21) Appl. No.: 16/377,545

(22) Filed: Apr. 8, 2019

Related U.S. Application Data

(60) Provisional application No. 62/657,459, filed on Apr. 13, 2018.

(51) Int. Cl.
*A44B 18/00* (2006.01)

(52) U.S. Cl.
CPC ..... *A44B 18/0069* (2013.01); *A44B 18/0003* (2013.01); *Y10T 24/47* (2015.01)

(58) Field of Classification Search
CPC . Y10T 24/4745; Y10T 24/4709; Y10T 24/27; Y10T 24/2708; Y10T 24/4736; Y10T 24/47; Y10T 24/1374; Y10T 24/1379; Y10T 24/1397; A44B 18/0069; A44B 18/0003
See application file for complete search history.

(56) References Cited

U.S. PATENT DOCUMENTS 1,130,438 A 3/1915 Schmidt
4,030,689 A * 6/1977 Rodriguez ..... B64D 17/38 244/151 B
D300,281 S 3/1989 Coates
5,702,039 A 12/1997 Olaiz
7,032,248 B1 4/2006 Gutilla
2008/0127461 A1* 6/2008 Linden ..... A45F 5/02 24/302
2008/0203127 A1 8/2008 Castillo-Garrison
2008/0244877 A1* 10/2008 Sell ..... D06F 95/008 24/306
2009/0000083 A1 1/2009 Richard et al.

* cited by examiner

*Primary Examiner* — Robert Sandy
*Assistant Examiner* — Michael S Lee
(74) *Attorney, Agent, or Firm* — Creativenture Law, LLC; Kevin C. Staed; Dennis J M Donahue, III

(57) ABSTRACT

The lanyard described herein includes a double fastener for securely supporting an accessory, such as a watch face, phone or other item on a lanyard. The lanyard is preferably made from a traditional length of material that is intended to be worn around the neck of a wearer to provide access to an item held on an end of the lanyard near the chest of the wearer. The double fastener includes a latch strip connected to a base portion of the lanyard at one end with the other end looped back over and connected to the base portion by a hook-and-loop connection. The latch is subsequently secured by a locking mechanism which overlaps the latch and locks it in the fastened orientation. Accordingly, the double fastener not only supports the accessory with a latch but also ensures the latch does not inadvertently come undone by way of the lock.

20 Claims, 4 Drawing Sheets

LANYARD WITH DOUBLE FASTENER

CROSS-REFERENCE TO RELATED APPLICATIONS

This application claims priority from U.S. Provisional Patent Application No. 62/657,459 filed on Apr. 13, 2018 which is incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to lanyards, and more particularly to a double fastener for securely supporting an accessory on a lanyard.

Related Art

Lanyards have long been used for supporting accessories and various items while simultaneously allowing the hands of the wearer to be free. Generally, a lanyard is a cord or strap worn around the neck, shoulder or wrist to carry such items as a keys, identification cards, phones, watches, cameras, tickets, flash drives or various other items. Most lanyards have a loop of material with a fastener at one end that attaches to an aforementioned accessory. Further, the type of fastener generally varies according to the particular lanyard design or the item intended to be held. For example, common fasteners that are used include hook-and-loop fasteners, buckles, clasps, snaps and other fastener variations. As it is generally the function of a lanyard to securely hold and item, there is a desire to those having an ordinary skill in the art to provide an improved lanyard and fastening mechanism that more securely connects an accessory to a lanyard.

Hook-and-loop and loop fasteners have routinely been incorporated into the fastening mechanism for holding an item, including in lanyards. For example, US Patent Application Number 2008/0203127 particularly describes a lanyard having a series of fasteners supported thereon with one of the fasteners being a Velcro® hook-and-loop fastener. As indicated in the '127 application, this hook-and-loop fastener may be used to support accessory items such as but not limited to a pacifier, a timer, a safety or recess whistle, a watch, lip balm, a pen, an ID badge, a fishing/sporting/hunting license, a ski lift ticket, a thumb drive, a flashlight, a carabineer, a wraparound fishing pole/fly rod to stabilize pole/rod while tying on new lure/fly, and a bell. Another design has integrated a hook-and-loop fastener into a bib for an infant in order to support a pacifier, such as shown in U.S. Design Pat. D300,281.

In both instances referenced above a distal end of strip of material loops back over itself before connecting to a proximal end of the material wherein one of the distal and proximal end has the "hook" portion of the fastener which mates with the "loop" portion of the fastener on the opposite end. Accordingly, the hooks in the hook portion catch in the loops of the loop portion and the distal and proximal ends of the material are thereby bound together until such a time as when they are separated by peeling the two ends apart. When connected, an item is help between the ends of fabric and thereby supported.

Although effective, these hook-and-loop fastener designs are limited wherein only a single fastener is provided. Accordingly, if an accessory is pulled with force the single hook-and-loop fastener may tend to unwantingly separate and thereby release the item being held. In addition, the loops can become elongated or broken after extended use rendering the fastener less secure.

Because of these shortcomings, there remains a need for an improved hook-and-loop fastener wherein a double fastener is provided. With the addition of a double fastener, the overall strength of the initial latch is increased wherein the primary hook-and-loop fastener secures an item as in the prior art but is also secured by a second latch that holds the first latch in place. Accordingly, there is a desire to those having skill in the art to provide an improved fastening device for use with a lanyard.

SUMMARY OF THE INVENTION

The xLanyard™ having a combination latch and lock described herein according to the preferred embodiment includes a multi-layer hook-and-loop fastener for securing an accessory, such as a watch face, phone or other item. The lanyard portion is preferably made from a traditional length of material that is intended to be worn around the neck of a wearer to provide access to an item held on an end of the lanyard near the chest of the wearer. Whereas other devices in the prior art provide the same functionality, the lanyard and double fastener described herein improves on lanyards and single fasteners in the prior art by integrating a latch and lock fastening system that not only removably connects the item to the lanyard with a latch but also incorporates a second locking fastener that secures the latch between the lanyard and the item being held.

In operation, the double fastener has a "T" shape with a latch having a strip extending through a mounting portion on the item being held. Preferably, the mounting portion is the end of a watch face but may also be a key ring, phone case, or other item wherein the strip extends through the mounting portion and supports the accessory within the loop. Accordingly, the end of the strip is looped back over the other end of the segment which are then secured to one another by a first hook-and-loop connection. To further secure the item to the lanyard, the second and third segments of the "T" shaped design loop over and connect with one another and overlap the first connection. Accordingly, the first segment is not only held in place by its own hook-and-loop connection but also by the additional hook-and-loop connection of the second and third segment.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

The xLanyard™ according to the preferred embodiment includes a double fastener having a latch that engages an accessory held from the lanyard and a lock that engages the latch and prevents the latch from unintentionally unfastening. The latch is capable of holding hundreds of objects which are supported within the loop of the latch. Subsequently, the latch is easily fastened and unfastened through a hook-and-loop fastener which is secured with the lock. Conversely, existing lanyard and fasteners for supporting an accessory from the lanyard had a single fastener that failed to provide the overall security of the accessory being held by the lanyard. Particularly, the single latch could easily come loose but the latch and lock double fastener provides the extra security as explained herein.

Although the latch and lock double fastener described herein preferably connects to a lanyard worn around the neck of a wearer, persons having an ordinary skill in the art will appreciate that the double fastener could also be used with other straps or devices that are designed to hold an accessory. Similarly, the accessory being held by the double fastener described herein is not intended to be limiting and may include but is not limited to keys, watches, smartwatches, smart phone cases, sunglasses, jewelry, ID badges, tools, pacifiers, timers, whistles, lip balm, writing utensils, thumb drives, flashlights, carabineers, bells and other accessories that a user may attach to a lanyard. Alternatively, the double fastener and lanyard can be enlarged to support heavier items such as hand tools being carried by workers or to help fireman carry hoses.

The double fastener and lanyard according to the preferred embodiment includes a flat bottom "V" shaped base that connects to the lanyard. The lanyard is generally made from a traditional lanyard material, such as fabric, leather, or faux leather but it will be appreciated that other lanyard materials may be used. Similarly, the material of the base portion of the double fastener is not intended to be limiting and may be made from various materials as with the lanyard described above.

As explained in detail below, the latch portion of the double fastener includes a first strip that is attached to the perimeter of the base portion at one end and the opposite end of the strip loops back and releaseably connects to a mounting position on the front face of the base. The latch is subsequently secured with a lock that overlaps the latch portion connected to the base. Accordingly, the lanyard includes a double fastener with a latch for holding the accessory and a lock that prevents the latch from inadvertently coming undone.

Figure 1B:
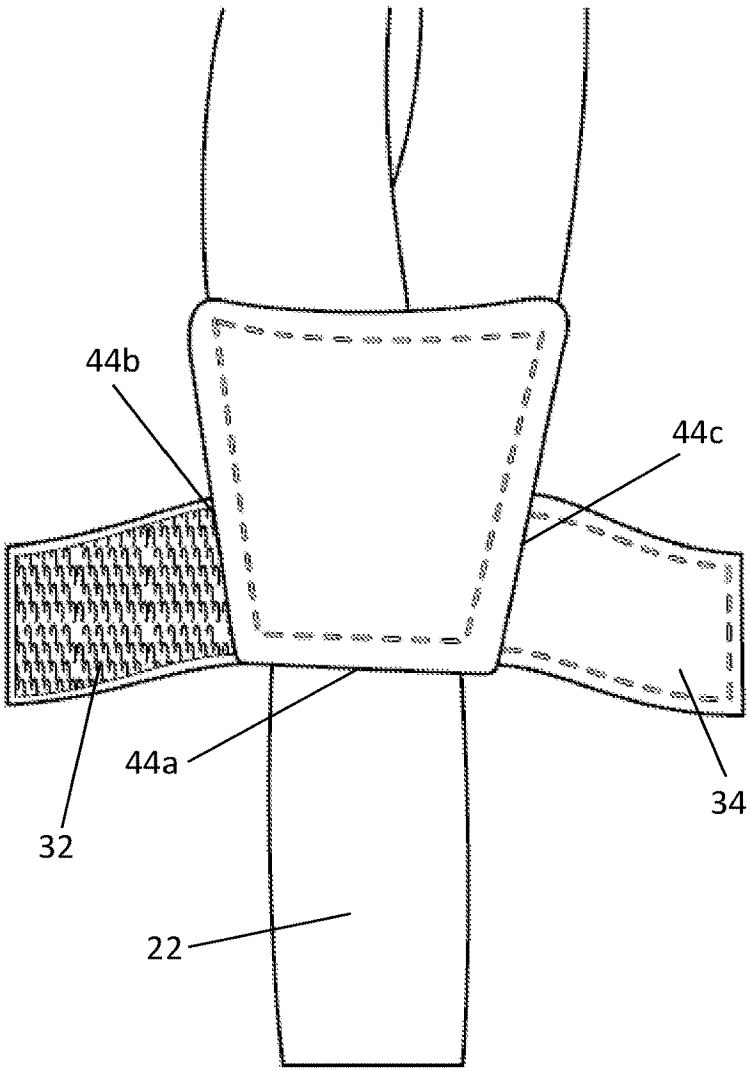
FIGS. 1A and 1B depict the double fastener according to the invention described herein in an unfastened arrangement.
Figure 1A:
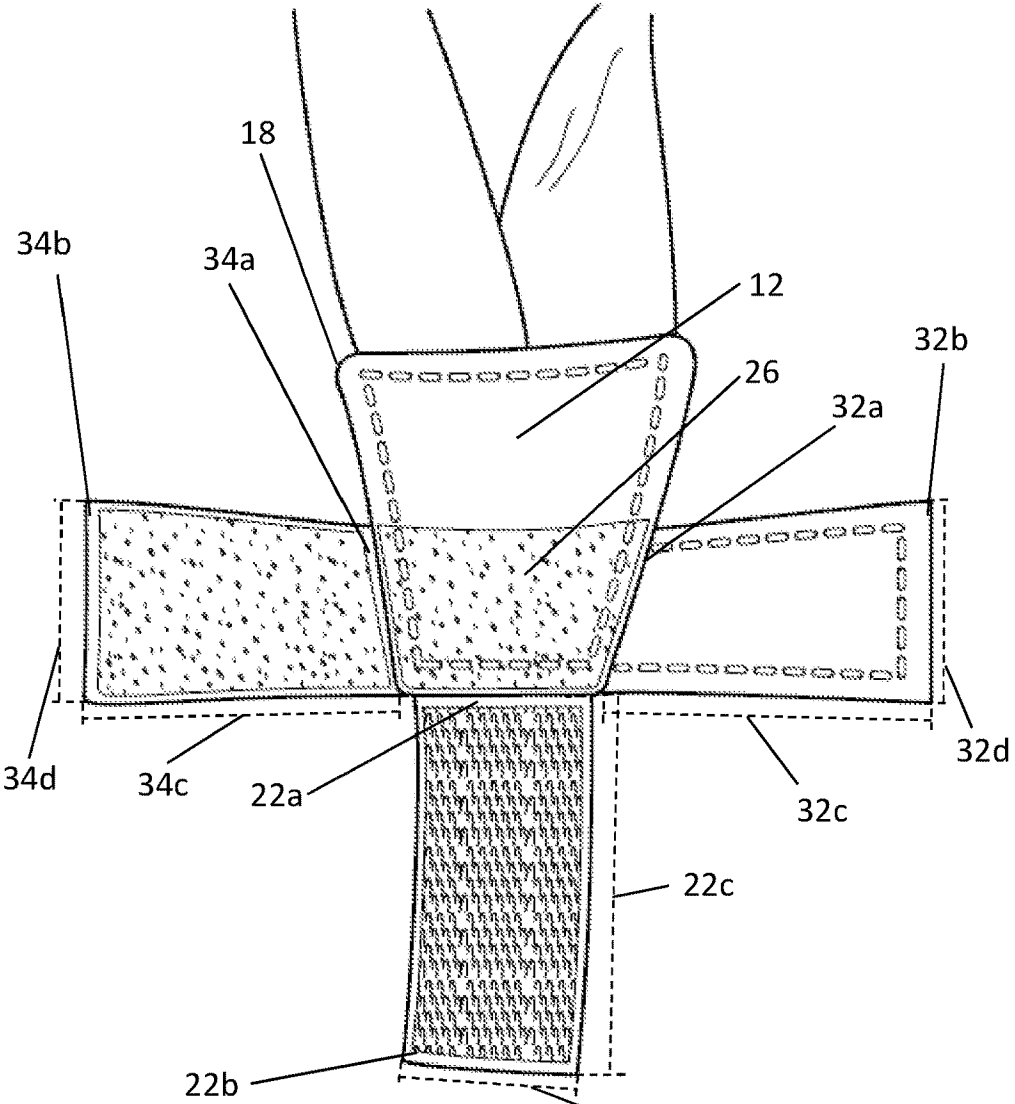

The double fastener 10 for supporting an accessory 100 on the end of a lanyard 102 described herein includes a base portion 12, latch 14 and lock 16. As shown in FIGS. 1A and 1B, the base portion has a front face 20*a*, back face 20*b* and perimeter edge 18. The base is permanently connected to the lanyard at the top edge and can be made from various materials but is preferably made from a faux or real leather material to provide sufficient rigidity to connect the lanyard, latch and lock that are generally made from nylon or other flexible materials. In addition, the front face of the base includes a mounting position 26, shown in FIG. 1A, for the latch which connects to the base at the mounting position as shown in FIG. 2. Preferably, the fastening mechanism for the latch is a hook-and-loop fastener 38 with one portion of the hook-and-loop being connected to the base, such as the soft loop portion 54 and the other being connected to the distal end of the latch, such as the hard hook portion 56, as explained below.

Figure 4C:
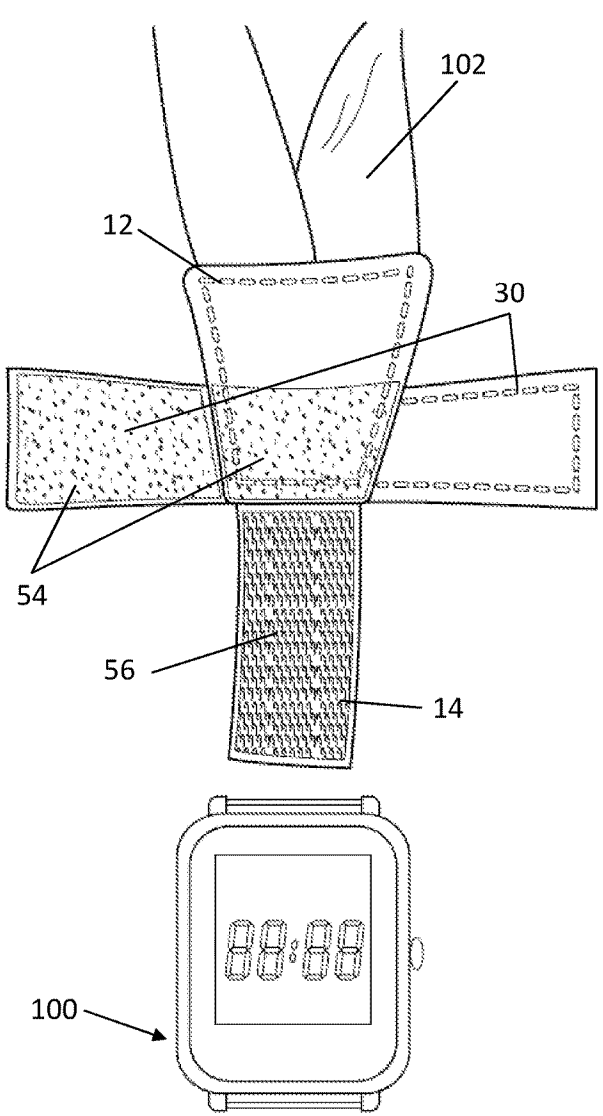
FIGS. 4B and 4C show detail views of accessories supported by the double fastener according to the invention described herein.
Figure 4B:
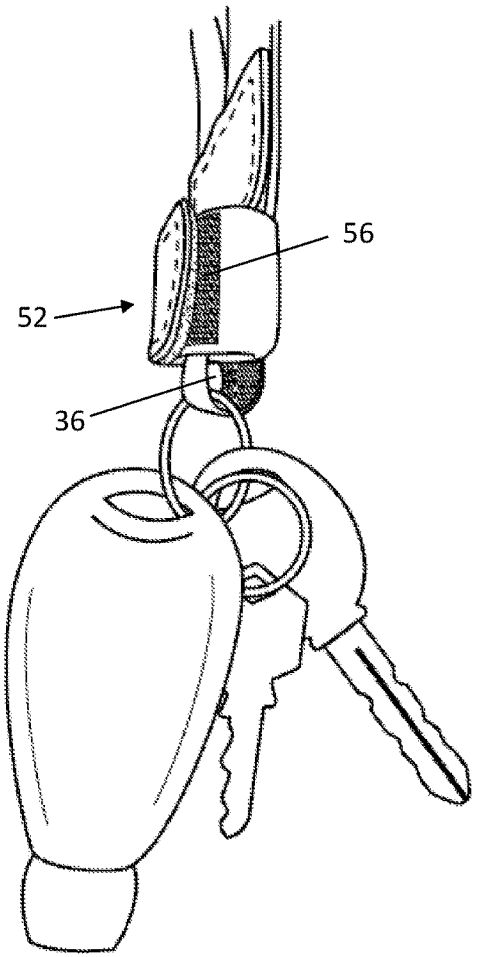
Figure 4A:
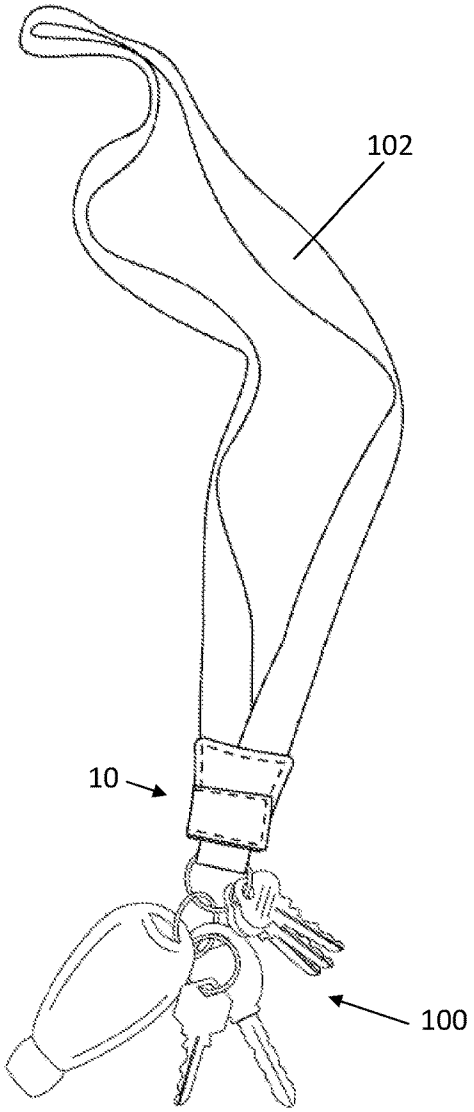
FIG. 4A shows a lanyard, double fastener and accessory according to the invention described herein.

The latch portion of the fastener is connected to the perimeter of the base preferably at a location 44*a* that is opposite from the lanyard. With the preferred flat bottom "V" shaped base, the latch extends from the bottom of the "V" while the lanyard is connected to the top portion of the "V". In this arrangement the loop provided by the latch when it is fastened to the base is directly beneath the lanyard and the accessory is held beneath the lanyard, such as depicted in FIG. 4A. However, it will be understood by those having an ordinary skill in the art that the proximal end of the latch that connects to the perimeter of the base does not necessarily connect at a position opposite from the lanyard connection. Accordingly, the loop may not be directly beneath the lanyard connection.

Figure 2A:
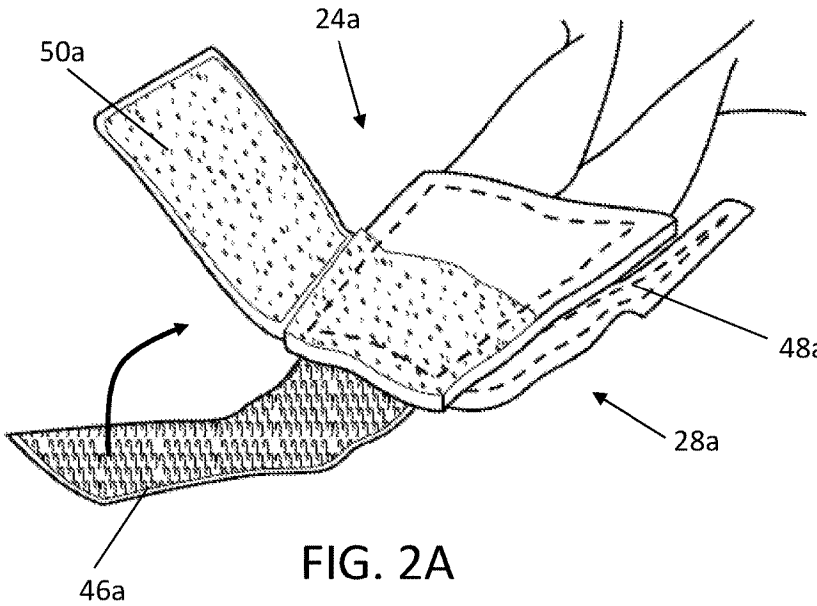
FIGS. 2A-2D illustrate the double fastener according to the invention progressing from the unfastened arrangement to the fastened arrangement.
Figure 2B:
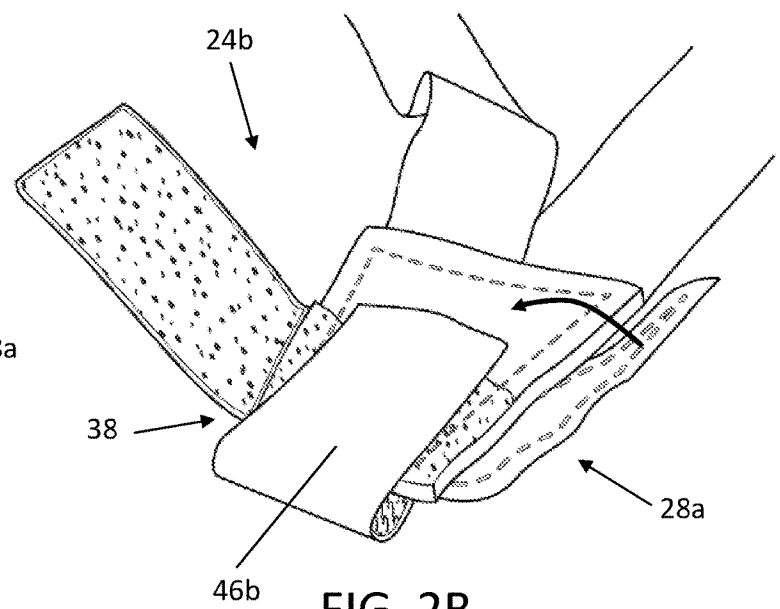
Figure 2C:
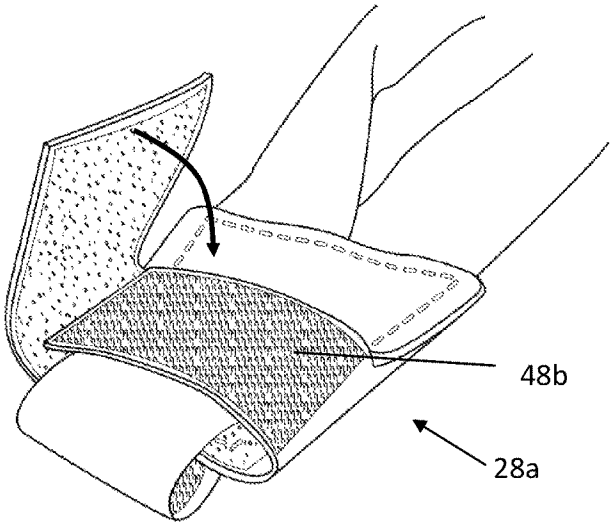

The latch is made of a strip 22 of material that extends a strip length 22*c* form its proximal end 22*a* connected to the base to the distal end 22*b*. As explained above, the face of the latch strip's distal end includes the opposite portion of the hook-and-loop fastener which releaseably connects to the mounting position on the base, such as shown in FIG. 2. In operation, the latch includes an unfastened orientation 24*a* and a fastened orientation 24*b* wherein the distal end releaseably fastens to the front face of the base. When fastened, the strip length forms a loop 36 as illustrated in FIG. 3C and the accessory is inserted through the loop as shown in FIG. 4B. Accordingly, the accessory is supported within the loop in the fastened orientation. Conversely, the accessory is unsupported by the latch in the unfastened orientation.

The double fastener also includes a lock having an unlocked orientation 28*a* and a unlocked orientation 28*b*. The lock overlaps the distal end of the latch when the latch is connected to the base in the fastened orientation and the lock is removed from the front surface of the base and latch in the unlocked orientation. Accordingly, the lock inhibits the latch from moving between the fastened orientation and the unfastened orientation when the lock is in the locked orientation. Conversely, the latch can freely move between the fastened orientation and the unfastened orientation when the lock is in the unlocked orientation.

The preferred lock is comprised of a second latch 30 as described below and particularly shown in FIGS. 1-3. However, it will be understood that the type of lock being used is not limited to the preferred second latch describe herein and shown in the drawings. Other lock types that effectively overlap the latch in the fastened orientation with a locking segment 42 may include but are not limited to a metal, plastic or fabric sleeve and a removable tie that is not connected to the base.

In the preferred embodiment shown in the drawings, the lock includes a second latch having two lock strips 32 and 34 connected on opposite sides of the base's perimeter, as particularly shown in FIG. 1. As with the latch strip described above, the lock strips making up the second latch respectively include a strip length 32*c* and 34*c* separating the proximal ends 32*a* and 34*a* and distal ends 32*b* and 34*b* of the lock strips. Although the overall dimensions of the latch strip and lock strips are not intended to be limited and may vary relative to the intended use of the device or accessory intending to be held, the strip length is preferably at least twice the strip width 22*d*, 32*d* and 34*d*.

In operation, the proximal ends of the strips are connected at respective locations 44*b* and 44*c* around the perimeter of the base and radially offset from one another. As explained with reference to the proximal end of the latch strip being connected to the perimeter at a location opposite from the lanyard, the proximal ends of the lock strips are connected at locations on opposite sides of the perimeter as shown in FIG. 1A. With the preferred flat bottom "V" shaped base, the first lock latch extends from one side of the "V" while the other lock latch extends from the opposite side of the "V". Accordingly, the latch strip and lock strips in the preferred embodiment form a "T" shaped double fastener where the strip lengths respectively extend in different directions from the perimeter of the base with the lock strips being opposite from one another.

Figure 2D:
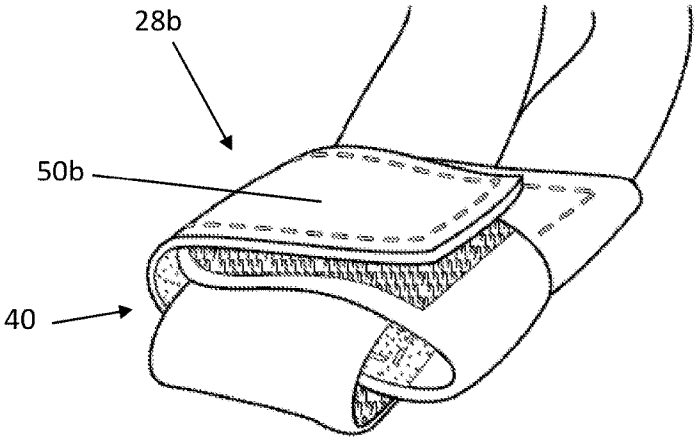

When moving the lock into the locked orientation, the distal ends of the lock strips releaseably connect to one another and overlap the fastened latch as particularly shown in FIG. 2D. Preferably, the distal ends are connected by a second hook-and-loop fastener 40 and collectively overlap the distal end of the latch in the locked orientation. Conversely, the distal ends of the lock strips are unfastened and do not overlap the latch in the unlocked orientation, as depicted in FIG. 2B.

Although hook-and-loop fasteners are preferably used to connect the distal ends of the locking strips together, other fasteners may effectively be used in place of a hook-and-loop fastener. For example, the distal end of one locking strip may releaseably connect to the other locking strip with a snap or a button rather than a hook-and-loop fastener. In addition, it will be understood that other fasteners may be used which include but are not limited to buckles, ties, magnets, pins, and hooks. Similarly, an alternative fastening mechanism may be used to connect the distal end of the latch strip to the mounting position on the front surface of the base.

As particularly shown in FIG. 2D, the distal end of the latch is sandwiched between the front face of the base and the lock when the latch is in the fastened orientation and the lock is in the locked orientation. Accordingly, the latch cannot be unfastened until the lock is unlocked. Similarly, the latch cannot be fastened if the lock is moved into the locked orientation before the latch is moved into the fastened orientation. Thus, there is a preferred order when fastening the latch and locking the lock as illustrated in FIG. 2. Namely, the length of the latch strip is inserted through the accessory to be held, such as a smartwatch as shown in FIG. 4D or a key ring as shown in FIG. 4 or watch. Next, the distal end of the latch is looped back over the strip length and fastened to the front surface of the base at the mounting position as illustrated in FIG. 2A. Next, the first lock strip is positioned over the distal end of the latch, illustrated in FIG. 2B, and the second lock strip is subsequently connected to the first lock strip, illustrated in FIG. 2C, and the accessory is thereby securely held by the lanyard with the double fastener as shown in FIG. 2D.

The fastened orientation and locked orientation collectively form a secured arrangement 52 with the accessory being secured to the lanyard byway of the innovative double fastener. This secured arrangement also includes fail-safes that stop users from fastening the innovative latch and lock in alternative arrangements that are less secure than the intended arrangement described herein. In particular, in the secured arrangement the distal end of the second lock strip is positioned overtop of and connected to the distal end of the first lock strip as shown in FIG. 3C. When the second latch is used as the locking mechanism, it is an aspect of the invention that the first lock strip is incapable of connecting to the second lock strip if the first lock strip is positioned overtop of the second lock strip. Thus, there is only a single locked orientation to effectively arrive at the secured arrangement.

Figure 3A:
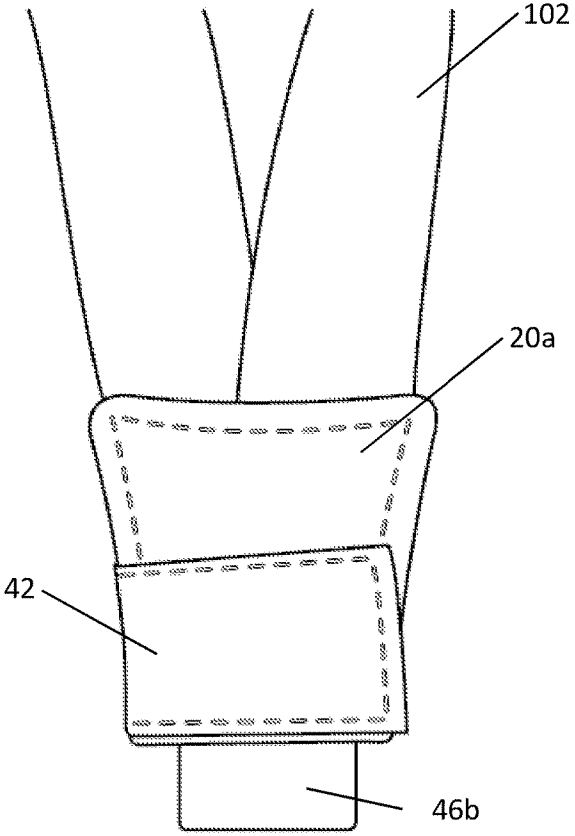
FIGS. 3A-3C depict the double fastener according to the invention described herein in the fastened arrangement.
Figure 3B:
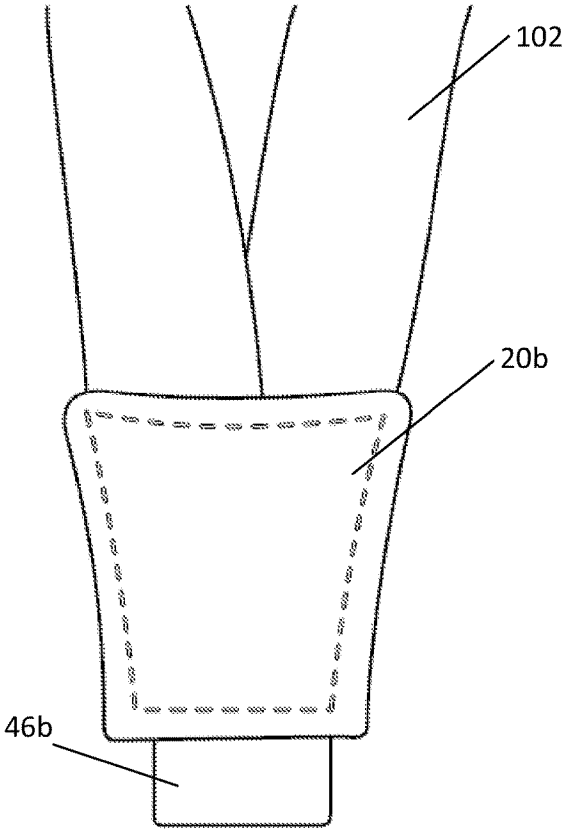
Figure 3C:
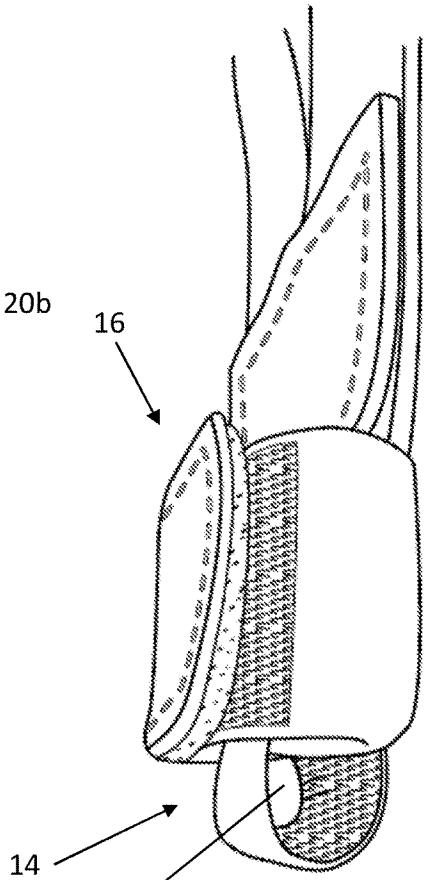

As shown in FIGS. 1-3, the latch strip and locking strips each have a first face and a second face opposite from one another. To further prevent unintended fastening arrangements, it is an aspect of the preferred design to have the first face 46*a* of the latch strip's connect to the mounting position in the fastened orientation where the second face 46*b* of the latch strip nonconnectively abuts the first face 48*a* of the first locking strip. Thus, the second face of the latch strip cannot unintentionally connect to the mounting position on the front face of the base or the first face of the first locking strip. Similarly, the second face 48*b* of the first locking strip releasebly connects to the first face 50*a* of the second locking strip and the locking strips cannot otherwise connect in the locked orientation where the second face 50*b* of the second locking strip is made from a smooth material, such as faux leather as explained herein.

In embodiments that do not include a second latch to lock the first latch in the fastened orientation, such as when a sleeve is used, it is an aspect of the latch to similarly not connect to the lock. In such an embodiment the sleeve is accordingly slid over the latch and held in place by a friction fit in the locked position.

Although the accessory to be held by the lanyard and double fastener may vary, the preferred double fastener is particularly useful for connecting a lanyard to a watch as shown in FIG. 4D. In operation the latch is fed between the pin connectors on the base of the watch and the watch is subsequently supported in the loop when the latch is fastened. In this embodiment the lanyard and double fastener allows the wearer to have their watch supported around their neck. However, it will be understood that the double fastener could also be integrated with a wrist or hand lanyard wherein the watch or other accessory is supported on the wrist or hand of the wearer.

The xLanyard™ can be used and worn by a wide range of users and is not limited to a specific type of user. However, it is particularly well suited for individuals who may be missing limbs or other persons who otherwise cannot readily wear a wrist watch, such as senior citizens, children, or professionals who are not allowed to wear jewelry on their arms or hands. For example, many hospitals prevent doctors and other medical professionals from wearing wristwatches due to growing infection concerns. Accordingly, the xLanyard™ provides an alternative device where individuals can still support their watch or other accessory around their neck. The xLanyard™ is also easily used for supporting a phone through a phone case. As explained above, the latch portion can be looped through a two-piece phone case and fastened with the double fastener.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A double fastener for supporting an accessory on a lanyard, comprising:

a base portion connected to the lanyard, wherein the base portion comprises a perimeter, a front face, a back face, a lanyard mounting position, a pair of latch mounting positions and a pair of lock mounting positions, wherein the lanyard mounting position, a first latch mounting position in the pair of latch mounting positions and the pair of lock mounting positions are located around the perimeter of the base portion, and wherein a second latch mounting position in the pair of latch mounting positions is located on the front face of the base portion;

a latch connected to the base portion, wherein the latch comprises a strip and moves between a fastened orientation and a unfastened orientation, wherein the strip comprises a proximal end, a distal end, and a strip length, wherein the proximal end is connected to the perimeter of the base at the first latch mounting position, wherein the distal end releaseably fastens to the second latch mounting position on the front face of the base in the fastened orientation, wherein the latch supports the accessory in the fastened orientation, and wherein the accessory is unsupported by the latch in the unfastened orientation; and a lock comprising a second strip and a third strip, wherein the lock moves between a locked orientation and an unlocked orientation, wherein the second strip comprises a second proximal end and a second distal end, wherein the third strip comprises a third proximal end and a third distal end, wherein the second proximal end and the third proximal end are connected to the perimeter of the base at the pair of lock mounting positions, respectively, wherein the second distal end and the third distal end releasebly overlap and connect to one another and overlap the distal end of the latch when the latch is in the fastened orientation and the lock is in the locked orientation, and wherein the second distal end is disconnected from the third distal end in the unlocked orientation.

2. The fastener of claim 1, wherein the lock inhibits the latch from moving between the fastened orientation and the unfastened orientation when the lock is in the locked orientation, and wherein the latch freely moves between the fastened orientation and the unfastened orientation when the lock is in the unlocked orientation.

3. The fastener of claim 1, wherein the strip length forms a loop in the fastened orientation, wherein the accessory is inserted through the loop in the fastened orientation, and wherein the distal end is separated from the front face by the strip length in the unfastened orientation.

4. The fastener of claim 1, wherein the distal end of the strip connects to the second latch mounting position on the front face by a hook-and-loop connection in the fastened orientation.

5. The fastener of claim 1, wherein the distal end, the second distal end and the third distal are parallel to one another when the latch is in the fastened orientation and the lock is in the locked orientation.

6. The fastener of claim 1, wherein the lanyard mounting position, the first latch mounting position, and the pair of lock mounting positions are radially spaced around the perimeter of the base, wherein the lanyard mounting position is opposite from the first latch mounting position, and wherein the pair of lock mounting positions are opposite from one another.

7. The fastener of claim 1, wherein the distal end of the strip connects to the second latch mounting position on the front face by a first hook-and-loop connection in the fastened orientation, and wherein the second distal end connects to the third distal end by at least one of a second hook-and-loop connection, a snap, and a button in the locked orientation.

8. The fastener of claim 1, wherein the distal end is sandwiched between the front face of the base and the second distal end and the third distal end in the locked orientation.

9. The fastener of claim 1, wherein the second strip and the third strip further comprise a second strip length and a third strip length, respectively, wherein the strip, the second strip and the third strip further comprise a strip width, a second strip width, and a third strip width, wherein the strip length is at least twice the strip width, wherein the second strip length is at least twice the second strip width, and wherein the third strip length is at least twice the third strip width.

10. The fastener of claim 1, wherein the fastened orientation and locked orientation collectively form a secured arrangement, wherein the secured arrangement comprises the third distal end overtop of the second distal end overtop of the first distal end connected to the mounting position of the base, wherein the distal end, the second distal end, and the third distal end each comprise a first face and a second face on opposite sides of the strip, the second strip and the third strip, respectively, wherein the first face of the distal end is connected to the second latch mounting position in the fastened orientation, wherein the second face of the strip nonconnectively abuts the first face of the second distal end, and wherein the second face of the second distal end releaseably connects to the first face of the third distal end in the locked orientation.

11. A double fastener for supporting an accessory on a lanyard, comprising:

a base portion connected to the lanyard, wherein the base portion comprises a perimeter, a front face and a back face, a lanyard mounting position, a pair of latch mounting positions and a pair of lock mounting positions, wherein the lanyard mounting position, a first latch mounting position in the pair of latch mounting positions and the pair of lock mounting positions are located around the perimeter of the base portion, and wherein a second latch mounting position in the pair of latch mounting positions is located on the front face of the base portion;

a latch comprising a strip, wherein the latch moves between a fastened orientation and an unfastened orientation, wherein the strip comprises a proximal end, a distal end, and a strip length, wherein the proximal end is permanently connected to the perimeter of the base at the first latch mounting position, wherein the distal end releaseably fastens to the second latch mounting position on the front face of the base in the fastened orientation, wherein the latch supports the accessory in the fastened orientation, and wherein the accessory is unsupported by the latch in the unfastened orientation; and a lock comprising a second strip and a third strip, wherein the lock moves between a locked orientation and an unlocked orientation, wherein the second strip comprises a second proximal end, a second distal end, and a second strip length, wherein the third strip comprises a third proximal end, a third distal end, and a third strip length, wherein the second proximal end and the third proximal end are connected to the perimeter of the base at the pair of lock mounting positions, respectively, wherein the third distal end overlaps and releaseably fastens to the second distal end in the locked orientation, wherein the second distal end overlaps the distal end and the third distal end overlaps the second distal end when the latch is in the fastened orientation and the lock is in the locked orientation, wherein the second distal end is separated from the third distal end in the unlocked orientation, wherein the distal end, the second distal end, and the third distal end each further comprise a first face and a second face on opposite sides of the strip, the second strip and the third strip, respectively, wherein the first face of the distal end is connected to the second latch mounting position in the fastened orientation, wherein the second face of the strip nonconnectively abuts the first face of the second distal end, and wherein the second face of the second distal end releaseably connects to the first face of the third distal end in the locked orientation.

12. The fastener of claim 11, wherein the distal end is sandwiched between the front face of the base and the second distal end when the latch is in the fastened orientation and the lock is in the locked orientation, wherein the second distal end is sandwiched between the distal end and the third distal end when the latch is in the fastened orientation and the lock is in the locked orientation, and wherein the distal end, the second distal end and the third distal are parallel to one another when the latch is in the fastened orientation and the lock is in locked orientation.

13. The fastener of claim 11, wherein the lock inhibits the latch from moving between the fastened orientation and the unfastened orientation when the lock is in the locked orientation, and wherein the latch freely moves between the fastened orientation and the unfastened orientation when the lock is in the unlocked orientation.

14. The fastener of claim 11, wherein the lanyard mounting position, the first latch mounting position, and the pair of lock mounting positions are radially spaced around the perimeter of the base, wherein the lanyard mounting position is opposite from the first latch mounting position, and wherein the lanyard is permanently attached to lanyard mounting position.

15. The fastener of claim 11, wherein the strip length forms a loop in the fastened orientation, wherein the accessory is inserted through the loop in the fastened orientation, and wherein the distal end is separated from the front face by the strip length in the unfastened orientation.

16. The fastener of claim 11, wherein the distal end connects to the second latch mounting position on the front face by a first hook-and-loop connection in the fastened orientation, and wherein the second distal end connects to the third distal end by a second hook-and-loop connection in the locked orientation.

17. An accessory holder having a double fastener, comprising:

a lanyard;

a base connected to the lanyard, wherein the base comprises a perimeter, a front face and a back face, a lanyard mounting position, a first strip mounting position, and a plurality of other strip mounting positions, wherein the first strip mounting position is situated on the front face of the base, wherein the lanyard mounting position and the plurality of other strip mounting positions are situated around the perimeter of the base, and wherein the lanyard is permanently attached to the lanyard mounting position;

a first strip comprising a proximal end and a distal end, wherein the proximal end is connected to a first position in the plurality of other strip mounting positions situated around the perimeter of the base, wherein the first strip extends a strip length from the proximal end to the distal end, wherein the distal end folds over the strip length and releaseably connects to the first strip mounting position on the front face of the base with a first hook-and-loop fastener in a fastened orientation, and wherein a loop is formed in the fastened orientation, and wherein the distal end is removed from the mounting position in an unfastened orientation;

a second strip comprising a second proximal end and a second distal end, wherein the second proximal end is connected to a second position in the plurality of other strip mounting positions situated around the perimeter of the base, wherein the second position is radially offset from the first position around the perimeter of the base, wherein the second strip extends a second strip length from the second proximal end to the second distal end, wherein the second distal end folds over the second strip length and overlaps the distal end when the distal end is in the fastened orientation, and wherein the distal end is sandwiched between the first strip mounting position on the front face of the base and the second distal end; and a third strip comprising a third proximal end and a third distal end, wherein the third proximal end is connected to a third position in the plurality of other strip mounting positions situated around the perimeter of the base, wherein the third position is opposite from the second position, wherein the third strip extends a third strip length from the third proximal end to the third distal end, wherein the third distal end folds over the third strip length and releaseably connects to the second distal end with a second hook-and-loop fastener in a locked orientation, and wherein the second distal end is sandwiched between the distal end and the third distal end.

18. The holder of claim 17, wherein the second strip and the third strip inhibit the first strip from moving between the fastened orientation and the unfastened orientation when the second strip and the third strip are in the locked orientation, and wherein the first strip freely moves between the fastened orientation and the unfastened orientation when the second strip and the third strip are in the unlocked orientation.

19. The holder of claim 17, wherein the fastened orientation and locked orientation collectively form a secured arrangement, wherein the secured arrangement comprises the third distal end overtop of the second distal end overtop of the first distal end connected to the mounting position of the base, wherein the distal end, the second distal end, and the third distal end each comprise a first face and a second face on opposite sides of the first strip, the second strip and the third strip, respectively, wherein the first face of the distal end is connected to the first strip mounting position in the fastened orientation, wherein the second face of the distal end nonconnectively abuts the first face of the second distal end, and wherein the second face of the second distal end releaseably connects to the first face of the third distal end in the locked orientation.

20. The holder of claim 17, wherein the accessory is supported by the loop in the fastened orientation.

* * * * *